US009342986B2

(12) United States Patent
Dariush

(10) Patent No.: US 9,342,986 B2
(45) Date of Patent: May 17, 2016

(54) VEHICLE STATE PREDICTION IN REAL TIME RISK ASSESSMENTS

(71) Applicant: Honda Motor Co., Ltd., Tokyo (JP)

(72) Inventor: Behzad Dariush, San Ramon, CA (US)

(73) Assignee: Honda Motor Co., Ltd., Tokyo (JP)

( * ) Notice: Subject to any disclaimer, the term of this patent is extended or adjusted under 35 U.S.C. 154(b) by 135 days.

(21) Appl. No.: 14/190,981

(22) Filed: Feb. 26, 2014

(65) Prior Publication Data

US 2014/0244068 A1 Aug. 28, 2014

Related U.S. Application Data

(63) Continuation-in-part of application No. 13/775,515, filed on Feb. 25, 2013, now Pat. No. 9,050,980.

(60) Provisional application No. 61/776,687, filed on Mar. 11, 2013.

(51) Int. Cl.
*G08G 1/16* (2006.01)

(52) U.S. Cl.
CPC ..... *G08G 1/166* (2013.01)

(58) Field of Classification Search
CPC ..... G08G 1/166; G08G 1/167; G08G 1/165; G08G 1/16; G08G 1/161; G08G 1/163; G08G 1/096725; G08G 1/096741; G08G 1/096775; G01S 2013/9342; G01S 13/867; G01S 13/87; G01S 2013/935; G01S 2013/936; G01S 2013/9385; G01S 13/86; G01S 17/58; G01S 2013/9382
USPC ..... 701/1, 36, 96, 70, 300, 450
See application file for complete search history.

(56) References Cited

U.S. PATENT DOCUMENTS

| | | | | |
|---|---|---|---|---|
| 5,296,852 | A * | 3/1994 | Rathi | G08G 1/04 340/933 |
| 6,580,973 | B2 | 6/2003 | Leivian et al. | |
| 6,675,081 | B2 | 1/2004 | Shuman et al. | |
| 6,982,635 | B2 | 1/2006 | Obradovich | |
| 7,518,545 | B2 | 4/2009 | Minichshofer | |
| 7,966,127 | B2 | 6/2011 | Ono et al. | |
| 8,108,147 | B1 | 1/2012 | Blackburn | |
| 8,542,106 | B2 | 9/2013 | Hilsebecher et al. | |

(Continued)

OTHER PUBLICATIONS

Inoue, H. "Next step of driver assistance—Toyota's point of view," Jun. 8, 2010, Toyota Motor Corporation, pp. 29-37.

(Continued)

*Primary Examiner* — Truc M Do
(74) *Attorney, Agent, or Firm* — Arent Fox LLP

(57) ABSTRACT

A driver assistance system takes as input a number of different types of vehicle environment inputs including positions of objects in the vehicle's environment. The system identifies possible outcomes that may occur as a result of the positions of the objects in the environment. The possible outcomes include predicted positions for the objects involved in each outcome. The system uses the inputs to determine a likelihood of occurrence of each of the possible outcomes. The system also uses the inputs to determine a current risk value for objects as well as predicted risk values for objects for the possible outcomes. A total risk value can be determined by aggregating the current and predicted risk values of an object weighted by the likelihood of occurrence. Total risk values for objects can be used to determine how the driver assistance system responds to the inputs.

14 Claims, 14 Drawing Sheets

(56) References Cited

U.S. PATENT DOCUMENTS

| | | | | |
|---|---|---|---|---|
| 8,914,181 | B2 * | 12/2014 | Essame | B60W 30/18163 701/23 |
| 8,954,226 | B1 * | 2/2015 | Binion | G06Q 40/08 701/33.4 |
| 2004/0217851 | A1 * | 11/2004 | Reinhart | B60Q 9/008 340/435 |
| 2005/0021224 | A1 | 1/2005 | Gray | |
| 2005/0060069 | A1 | 3/2005 | Breed et al. | |
| 2005/0195383 | A1 | 9/2005 | Breed et al. | |
| 2006/0195231 | A1 * | 8/2006 | Diebold | B60R 21/013 701/1 |
| 2007/0043491 | A1 | 2/2007 | Goerick et al. | |
| 2007/0106475 | A1 * | 5/2007 | Kondoh | B60K 26/021 701/301 |
| 2007/0276577 | A1 | 11/2007 | Kuge et al. | |
| 2008/0084283 | A1 * | 4/2008 | Kalik | B60Q 9/00 340/435 |
| 2008/0097699 | A1 * | 4/2008 | Ono | B60R 21/0134 701/300 |
| 2008/0188996 | A1 | 8/2008 | Lucas et al. | |
| 2009/0051516 | A1 | 2/2009 | Abel et al. | |
| 2009/0076702 | A1 | 3/2009 | Arbitmann et al. | |
| 2009/0138201 | A1 * | 5/2009 | Eckstein | B60R 21/013 701/301 |
| 2009/0228174 | A1 * | 9/2009 | Takagi | B60T 8/17558 701/41 |
| 2009/0326818 | A1 * | 12/2009 | Koehler | B60W 30/12 701/300 |
| 2010/0085238 | A1 * | 4/2010 | Muller-Frahm | G01S 11/12 342/70 |
| 2010/0106418 | A1 | 4/2010 | Kindo et al. | |
| 2010/0131155 | A1 | 5/2010 | Becker et al. | |
| 2010/0208075 | A1 * | 8/2010 | Katsuno | B60Q 9/005 348/148 |
| 2010/0228419 | A1 | 9/2010 | Lee et al. | |
| 2010/0253526 | A1 | 10/2010 | Szczerba et al. | |
| 2011/0032119 | A1 * | 2/2011 | Pfeiffer | B60K 35/00 340/905 |
| 2011/0137527 | A1 * | 6/2011 | Simon | B60R 1/00 701/45 |
| 2012/0035846 | A1 * | 2/2012 | Sakamoto | G08G 1/166 701/301 |
| 2012/0083942 | A1 * | 4/2012 | Gunaratne | B60W 40/02 701/1 |
| 2012/0083960 | A1 * | 4/2012 | Zhu | G05D 1/0214 701/23 |
| 2012/0307059 | A1 * | 12/2012 | Yamakage | B60W 40/09 348/148 |
| 2012/0323479 | A1 * | 12/2012 | Nagata | B60Q 9/008 701/301 |
| 2012/0330541 | A1 * | 12/2012 | Sakugawa | G08G 1/166 701/301 |

OTHER PUBLICATIONS

Lattner, A. et al. "Knowledge-based Risk Assessment for Intelligent Vehicles," *International Conference Integration of Knowledge Intensive Multi-Agent Systems, KIMAS05, Modeling, Evolution and Engineering*, 2005, pp. 191-196, IEEE Press, Boston, USA.

Röckl, M. et al., "An Architecture for Situation-Aware Driver Assistance Systems," *IEEE*, 2007, pp. 2555-2559.

Wolf, M. T. et al., "Artificial Potential Functions for Highway Driving with Collision Avoidance," *2008 IEEE International Conference on Robotics and Automation*, May 19-23, 2008, pp. 3731-3736, Pasadena, CA, USA.

PCT International Search Report and Written Opinion, PCT Application No. PCT/US14/16945, Mar. 19, 2014, 10 pages.

PCT International Search Report and Written Opinion, PCT Application No. PCT/US14/21924, Jul. 30, 2014, 14 pages.

United States Office Action, U.S. Appl. No. 13/775,515, Jul. 15, 2014, 11 pages.

United States Office Action, U.S. Appl. No. 13/775,515, Jan. 16, 2014, 11 pages.

United States Office Action, U.S. Appl. No. 13/775,515, Oct. 23, 2014, 13 pages.

* cited by examiner

VEHICLE STATE PREDICTION IN REAL TIME RISK ASSESSMENTS

This application claims the benefit of U.S. Provisional Application No. 61/776,687, filed Mar. 11, 2013, and is a continuation in part of U.S. application Ser. No. 13/775,515 filed Feb. 25, 2013, both of which are incorporated by reference in their entirety.

FIELD OF ART

The disclosure relates to driver assistance systems and more particularly to driver assistance systems using fuzzy logic prediction.

BACKGROUND

Driver assistance systems are control systems for vehicles that aim to increase the comfort and safety of vehicle occupants. Driver assistance systems can, for example, provide lane departure warnings, assist in lane keeping, provide collision warnings, automatically adjust cruise control, and automate the vehicle in low speed situations (e.g., traffic).

Due to the general tendency to provide occupants with new safety and comfort functions, the complexity of modern vehicles has increased over time, and is expected to increase further in the future. The addition of new driver assistance features adds complexity to the operation of the vehicle. Since these driver assistance systems use light, sound, and active vehicle control, they are necessarily intrusive into the driver's control of the vehicle. Consequently, new driver assistance systems take time for drivers to learn. Drivers sometimes ignore or disable these systems rather than learn to use them.

SUMMARY

A driver assistance system receives and processes sensor inputs in order to provide risk assessments and assistance to the driver. Risk assessments are based on both the current information about objects in the vehicle's environment, as well as predictions about the future states of those objects. The driver assistance system uses risk assessments to actively control of the vehicle's actuators. Examples of actuators include the braking system, airbag control, light indicator systems and in-dash displays among others. By providing accurate risk assessments, the driver assistance system provides relative few false positives and consequently is easier for new drivers to understand, and thus less likely to be ignored or disabled.

In one embodiment, the driver assistance system takes as input a number of different types of vehicle environment inputs including positions of objects in the vehicle's environment. The system identifies possible outcomes that may occur as a result of the positions of the objects in the environment. The possible outcomes include predicted positions for the objects involved in each outcome. The system uses the inputs to determine a likelihood of occurrence of each of the possible outcomes. The system also uses the inputs to determine a current risk value for objects as well as predicted risk values for objects for the possible outcomes. A total risk value can be determined by aggregating the current and predicted risk values of an object weighted by the likelihood of occurrence. Total risk values for objects can be used to determine how the driver assistance system responds to the inputs.

The features and advantages described in the specification are not all inclusive and, in particular, many additional features and advantages will be apparent to one of ordinary skill in the art in view of the drawings and specification. Moreover, it should be noted that the language used in the specification has been principally selected for readability and instructional purposes, and may not have been selected to delineate or circumscribe the inventive subject matter.

The figures depict various embodiments for purposes of illustration only. One skilled in the art will readily recognize from the following discussion that alternative embodiments of the structures and methods illustrated herein may be employed without departing from the principles of the embodiments described herein.

DETAILED DESCRIPTION

Driver Assistance System Overview

Figure 1:
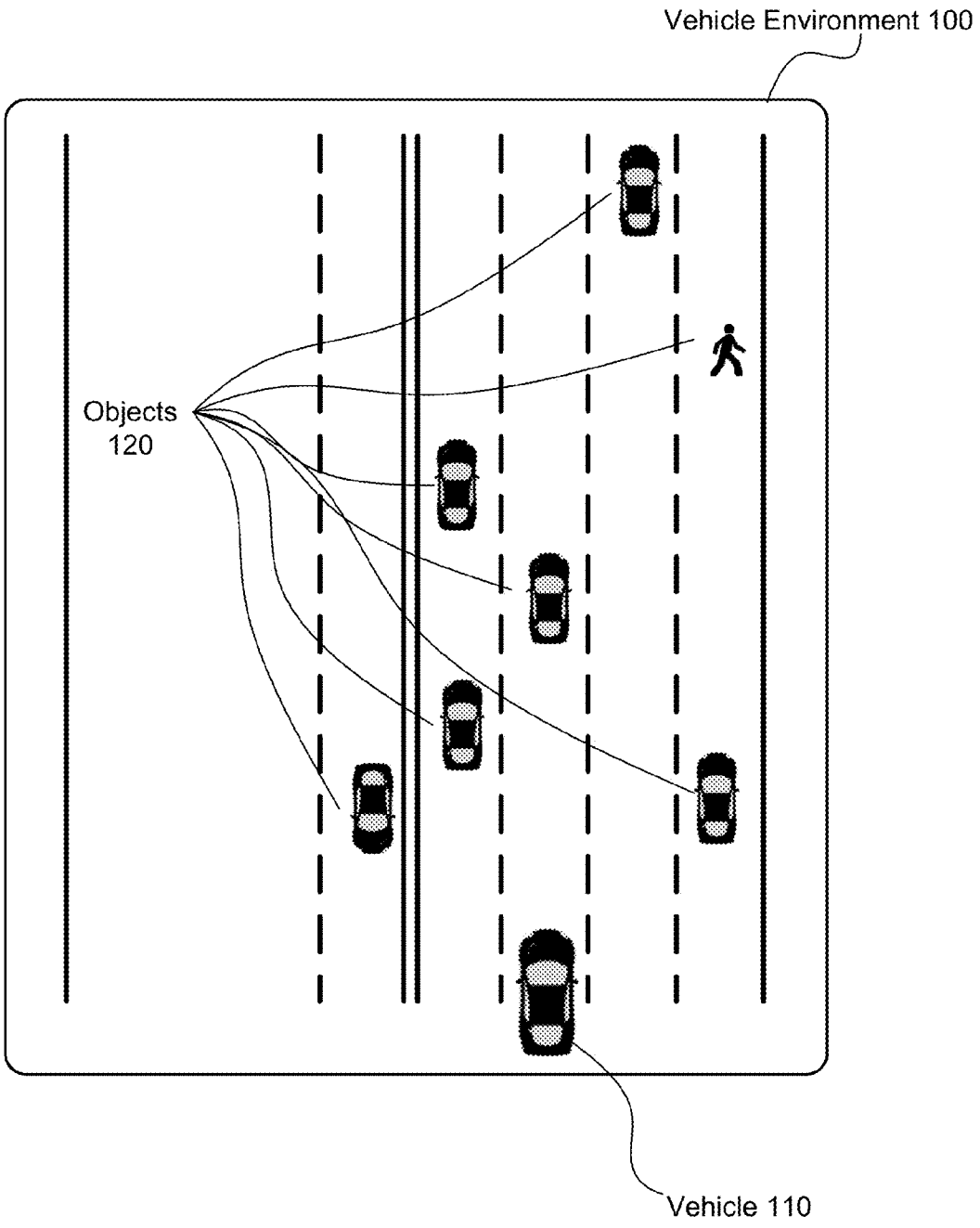
FIG. 1 illustrates a vehicle environment, according to one embodiment.

FIG. 1 illustrates an exemplary vehicle environment 100, according to one embodiment. The environment 100 surrounding a vehicle 110 includes objects 120 that are to be avoided. The driver assistance system assists the driver of the vehicle 110 in navigating the vehicle environment 100 to avoid the objects. The exact physical extent of the vehicle environment 100 around the vehicle may vary depending upon the implementation.

Objects 120 sought to be avoided include anything that can be present in the driver's path, for example, other vehicles, including cars, bicycles, motorcycles, trucks, etc., pedestrians, animals trees, bushes, plantings, landscaping, road signs, and stoplights. This list is intended to be exemplary, and is not considered to be comprehensive. Generally, the driver assistance system is capable of assisting the driver of a vehicle 110 in avoiding any physical object.

Figure 2:
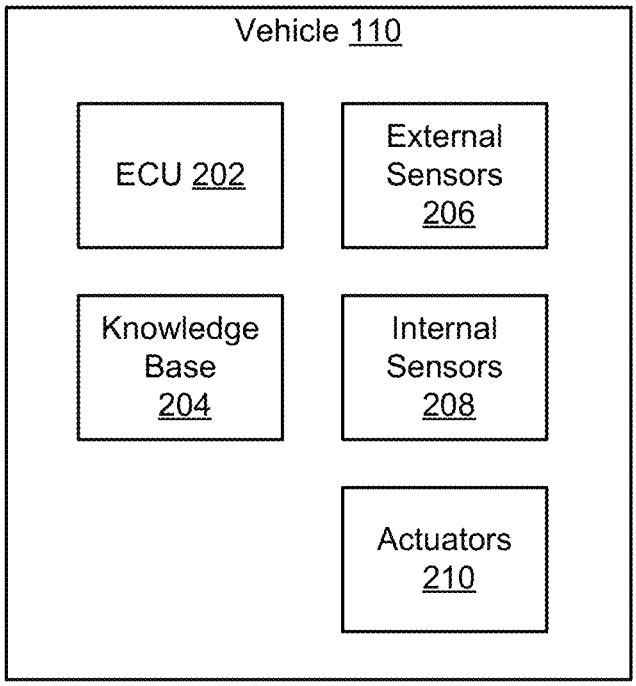
FIG. 2 is a block diagram illustrating exemplary components of a vehicle with respect to a driver assistance system, according to one embodiment.

FIG. 2 is an exemplary block diagram illustrating components of the vehicle 110 with respect to a driver assistance system, according to one embodiment. The vehicle includes one or more electronic control units (ECUs) 202, a knowledge base 204 including a set of rules for use with the driver assistance system, external 206 and internal 208 sensors for collecting vehicle environment inputs for the driver assistance system, and actuators 210 for controlling the vehicle based on the output of the driver assistance system.

The sensors 206 and 208 collect input data regarding the environment surrounding the vehicle 110. External sensors 206 include, for example, radio detecting and ranging (RADAR) sensors for detecting the positions of nearby objects 120. Light detecting and ranging (LIDAR) may also be used in external sensors 206 in addition to or in place of RADAR. Both RADAR and LIDAR are capable of determining the position (in two dimensions, e.g., the X and Y directions) as well as the distance between a sensed object 120 and the vehicle 110. Although RADAR and LIDAR are provided as examples, other types of sensors may also be used to detect the positions of nearby objects.

RADAR, either alone or in combination with ECU 202 and knowledge base 204, can also provide semantic input information related to an object 120. For example, RADAR may identify an object position as well as a position of lane boundary markers. These inputs may be processed to provide as an input the lane in which a particular object 120 is located. RADAR may also provide information regarding the shape (e.g., physical extent, distance between different parts of the same mass) of an object 120. Consequently, the shape information may be correlated with information stored in the knowledge base 204 to identify the type of object 120 is being sensed (e.g., pedestrian, vehicle, tree, bicycle, large truck, small truck etc.).

External sensors 206 may also include external cameras operating in the visible or IR spectrums. External cameras may be used to determine the same or additional information provided by RADAR, alone or in conjunction with the ECU 202 and knowledge base 204.

External sensors 206 may also include a global positioning system (GPS) capable of determining and/or receiving the vehicle's position on the earth (i.e., its geographical position). External sensors 206 may include devices other than a GPS capable of determining this information, for example, the vehicle 110 may be connected to a data or voice network capable of reporting the vehicle's geographical position to an appropriately configured sensor 206. For example, a portable phone attached to a wireless network may provide geographical position information.

Based on the vehicle's 110 geographical position, one or more communications devices may be used to obtain information relevant to (i.e., local or proximate to the vehicle's position) including traffic information, road maps, local weather information, vehicle to vehicle communications, or other information that is related to otherwise impacts driving conditions. For example, ECU 202 may include or be coupled to a wireless communication device that is wirelessly communicatively coupled to an external voice or data network that may be used to download this information from a remote computing network located externally to the vehicle 110.

Internal sensors 208 include velocity, acceleration, yaw, tilt, mass, force, and other physical quantity sensors that detect the properties and movement of the vehicle 110 itself. In combination, internal sensors 208 and external sensors 206 allow the ECU 202 to distinguish between changes to the vehicle versus changes in the vehicle environment. For example, the velocity and/or acceleration of an object 120 moving towards the vehicle 110 can be distinguished and separated from the velocity and/or acceleration of the vehicle 110 towards the object 120.

Internal sensors 208 also include driver awareness sensors that detect whether the driver is paying attention and/or what the driver is paying attention to. These internal sensors 208 may include, for example, an eye gaze sensor for detecting a direction of eye gaze and a drowsiness system for determining whether a driver is drowsy or sleeping (e.g., using a camera). Internal sensors 208 may also include weight or seatbelt sensors to detect the presence of the driver and passengers.

The external 206 and internal sensors 208 provide received information as data inputs to the ECU 202 for use with the driver assistance system. The ECU processes the received inputs in real time according the driver assistance system to generate four quadrant risks in real time indicating the current risk levels in four quadrants (left, right, front, and back) surrounding the vehicle 110. To generate the quadrant risks, the ECU 202 uses a knowledge base 204 including a set of rules for determining risk to the vehicle 110 posed by each of the objects 120 in the vehicle's environment detected by the sensors. The rules may be precompiled based on the behavior that an expert driver of the vehicle 110 would undertake to reduce harm to the vehicle 110 and its occupants. In one embodiment, the knowledge base 204 may be determined in advance and loaded into the vehicle 110 manually or downloaded wirelessly from a remote computer. In one embodiment, the knowledge base 204 may be tuned in advance or revised in the field based on the vehicle's configuration 110 (e.g., racecar vs. truck vs. minivan) or the driver's driving history. Thus, the knowledge base 204 may not be fixed and may be tuned to the patterns and experience of the driver.

The ECU 202 uses the generated quadrant risks to control, again in real time, the operation of one or more vehicle actuators 210. The vehicle actuators 210 control various aspects of the vehicle 110. Vehicle actuators 210 include, for example, the vehicle's throttle, brake, gearshift, steering, airbags, seatbelt pre-tensioners, side impact warning system, situation aware lane departure warning system, lane keeping warning system, entertainment system (both visual and audio), and a visual and/or audio display of the quadrant risk level. Responsive to one or more inputs received by the ECU 202 and based on the quadrant risks generated by the ECU 202, one or more of the vehicle's actuators 210 may be activated to mitigate risk to the vehicle 110 and its occupants.

For the situation aware lane departure warning system, the quadrant risk may be used to dynamically adjust the amplitude of the warning provided by the warning system. For example, if the vehicle drifts to the lane to its right and the right quadrant risk is comparatively low, then the warning level provided by the warning system may also be comparatively low. In contrast, if the vehicle drifts to the lane to its right and the quadrant risk is comparatively high, then the warning level provided by the warning system may also be comparatively high.

For the display of the quadrant risks, either an existing display may be used to display the quadrant risk (e.g., some portion of the vehicle dashboard or a screen of the audio/video system and/or on-board navigation system), or a separate display may be added to the vehicle for this purpose. The quadrant risks may be displayed in numerical format and/or in a color coded or visually distinguishing format.

In one implementation, the sensors 206 and 208, ECU, knowledge base 204 and actuators are configured to communicate using a bus system, for example using the controller area network (CAN). In one implementation, the ECU 202 includes a plurality of ECUs rather than being unified into a single ECU. The CAN bus allows for exchange of data between the connected ECUs. In one implementation, the knowledge base 204 is stored in non-transitory computer readable storage medium. The ECU 202 comprises a processor configured to operate on received inputs and on data accessed from the knowledge base 204.

Figure 3A:
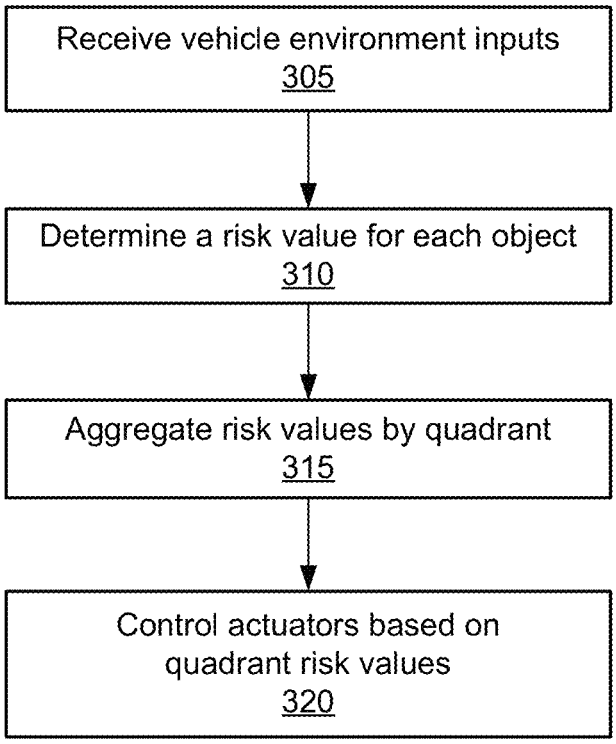
FIG. 3A is a block diagram illustrating an exemplary process for assisting a driver, according to one embodiment.

FIG. 3A is a block diagram illustrating an exemplary process for assisting a driver, according to one embodiment. The driver assistance system receives 305, in real time, a plurality of vehicle environment inputs through sensors 206 and 208. The driver assistance system processes, in real time, the inputs using the set of rules from knowledge base 204 to determine 310 a risk value for each object 120 in the environment 100. The driver assistance system aggregates 315 the risk values into quadrant risk values. The driver assistance system uses the quadrant risk values to control 320 the actuators 210 on the vehicle (e.g., a heads up display (HUD) displaying risk information, brakes, airbags, etc).

Figure 8:
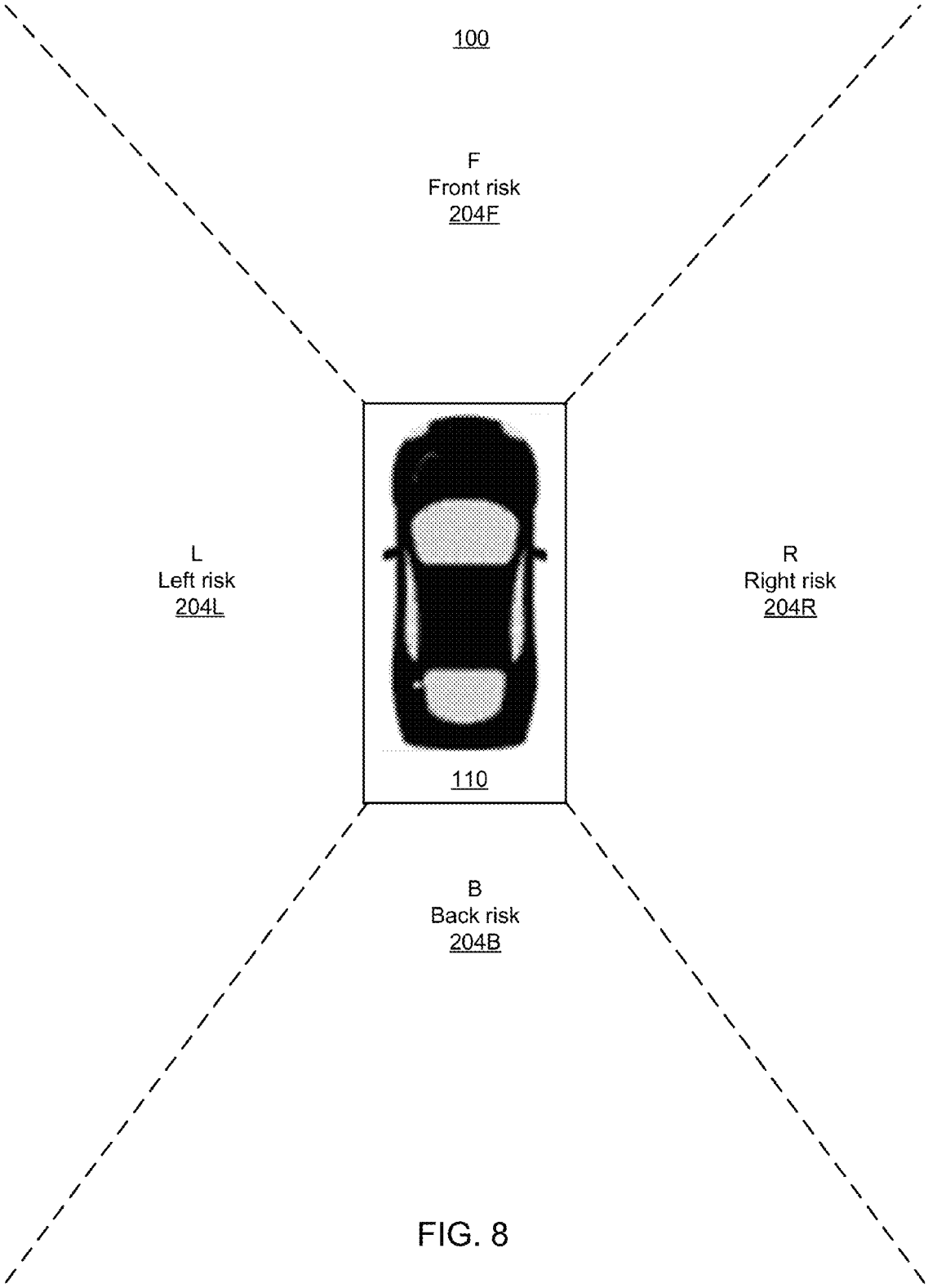
FIG. 8 illustrates an exemplary vehicle environment and the quadrants into which object risks are aggregated by the driver assistance system based on their position with respect to the vehicle, according to one embodiment.

FIG. 8 illustrates an exemplary vehicle environment 100 and the quadrants into which the object risks are aggregated by the driver assistance system based on their position with respect to the vehicle 110, according to one embodiment. The quadrant risk values include a front risk 204F, a right risk 204R, a back/behind risk 204B, and a left risk 204L. FIG. 8 further illustrates the quadrants the quadrant risks correspond to.

The front risk 20F is in a front quadrant including the area roughly in front of the vehicle as well as some of the area off to the left or right in front of the vehicle. The right risk 204R is in a right quadrant including the area to the right of the vehicle as well as some of the area in front of or behind the right of the vehicle. The back/behind risk 204B is in a back/behind quadrant including behind the vehicle, as well as some of the area off to the left or right behind the vehicle. The left risk 204L is in a left quadrant including the area of the left of the vehicle as well as some of the area in front of or behind the left of the vehicle.

Determination of Object Risk Values

Risk values for objects are determined 310 using a set of rules from knowledge base 204. The rules are not a strict set of if-then rules, though they may be loosely phrased that way. Rather, the rules comprise input membership functions in which inputs received by the sensors 206 and 208 may be at least partial members of more than one input membership function at a time. The rules map various permutations of input's degree of membership in particular input membership functions to particular risk membership functions.

Figure 3B:
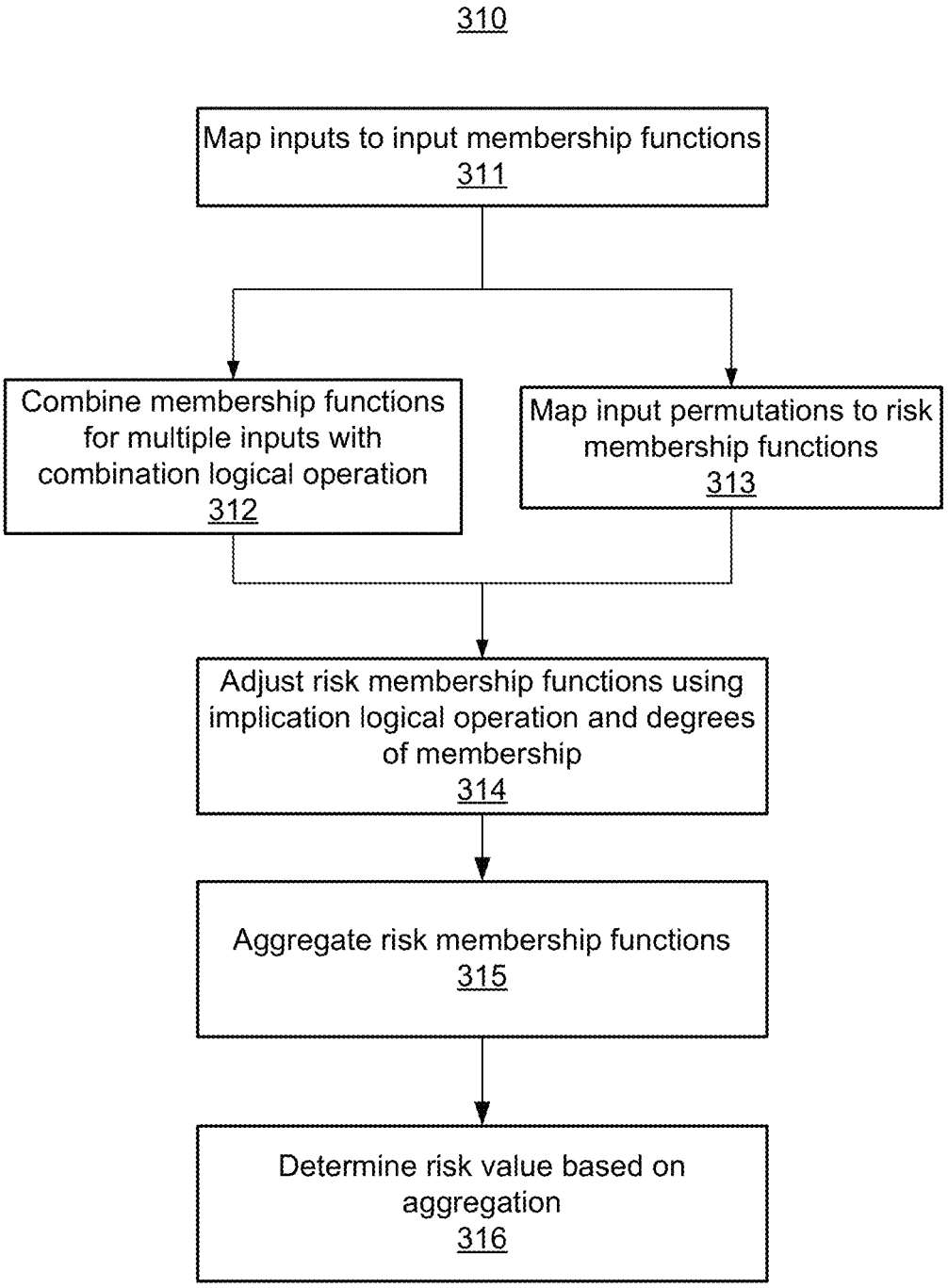
FIG. 3B is a block diagram illustrating an exemplary process for determining risk values, according to one embodiment.

FIG. 3B describes an exemplary process for determining 310 risk value using the set of rules from the knowledge base 204, according to one embodiment. Each rule includes a set of inputs, a set of input membership functions, a set of risk membership functions, and mappings between permutations of input membership functions and risk membership functions. These concepts will be described further below.

Figure 4:
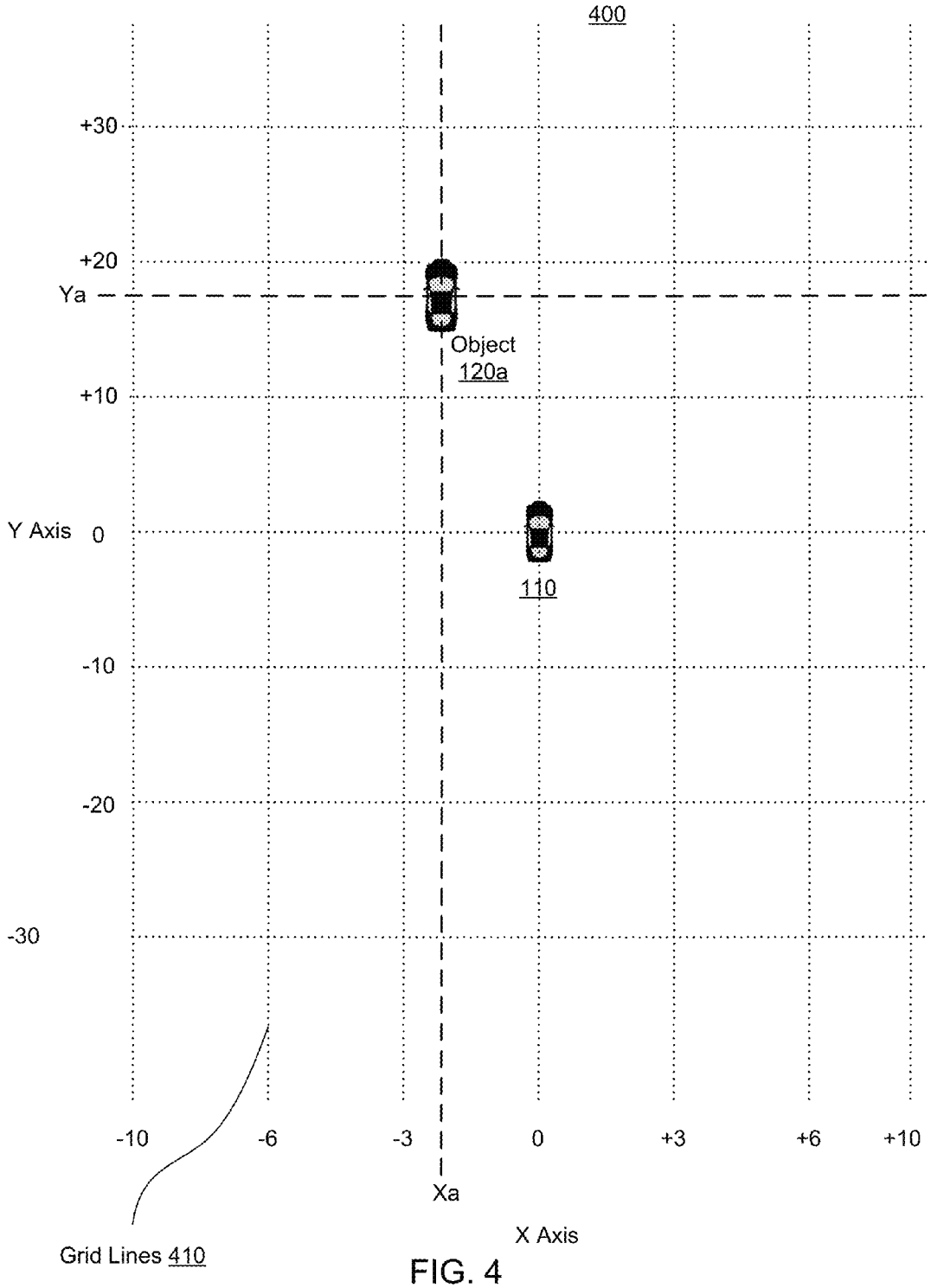
FIG. 4 is an exemplary grid illustration of a vehicle environment, according to one embodiment.
Figure 5:
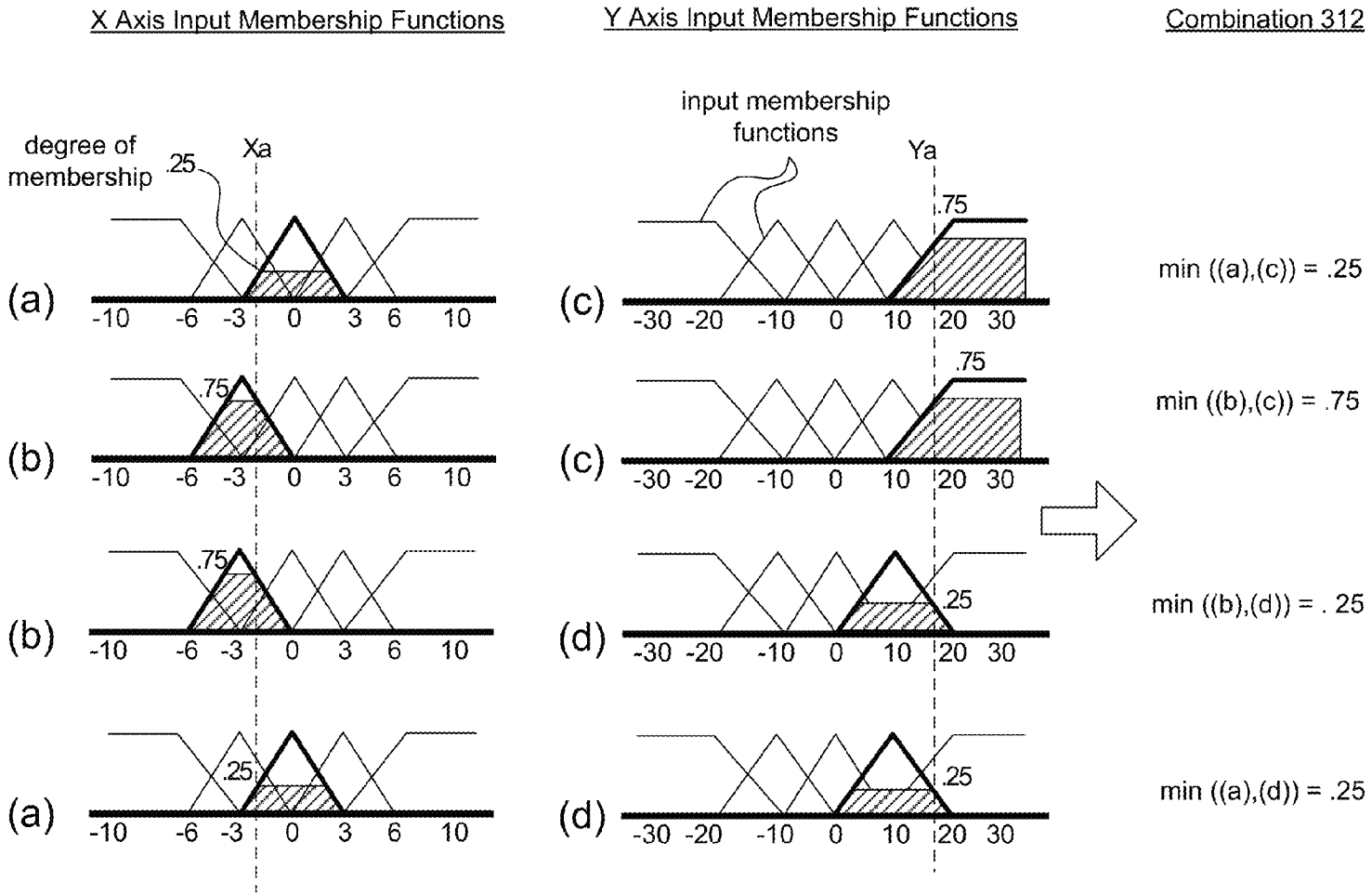
FIG. 5 illustrates exemplary input membership functions for evaluating the risk of an object in the vehicle environment, according to one embodiment.
Figure 6:
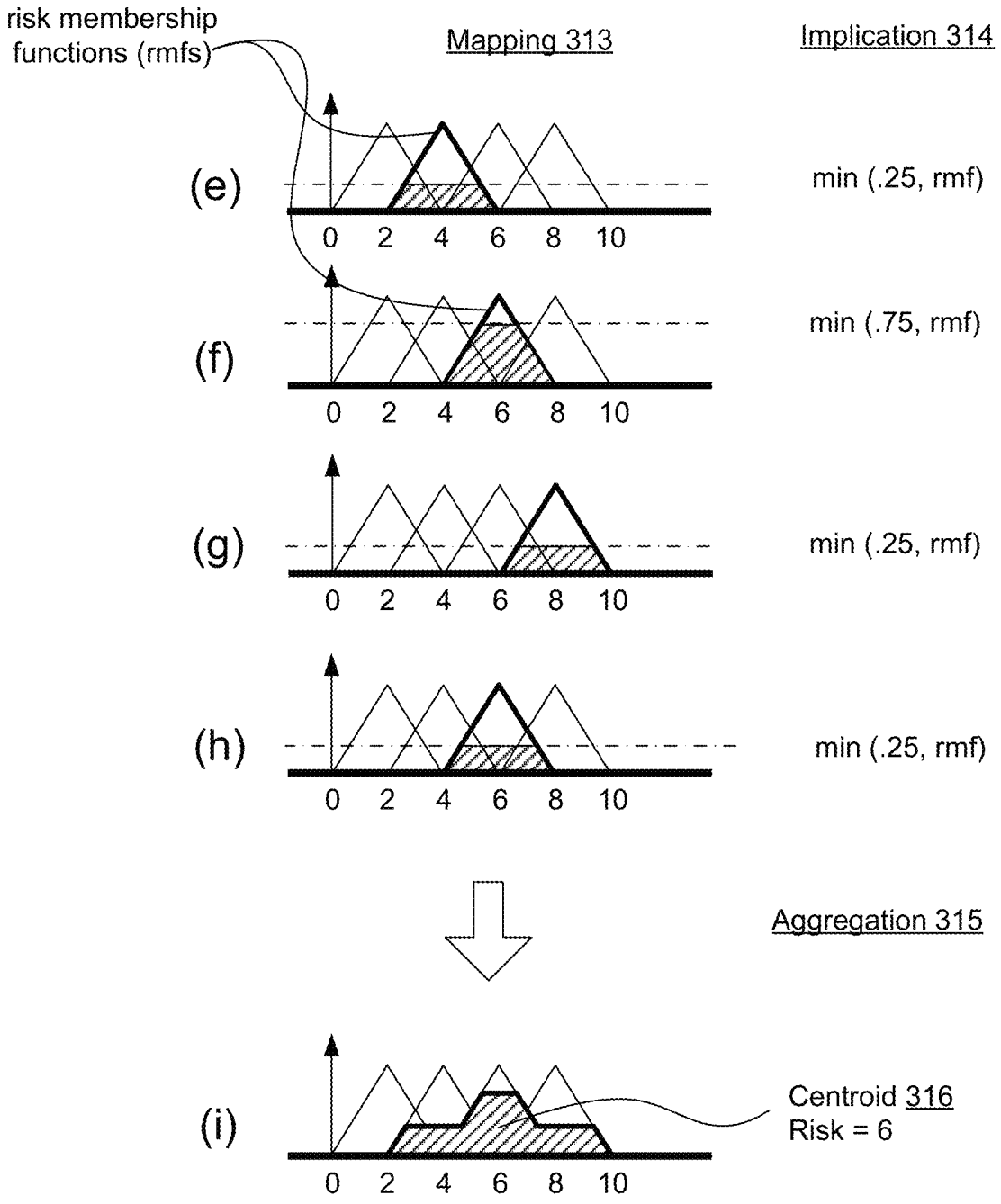
FIG. 6 illustrates exemplary risk membership functions for evaluating the risk of an object in the vehicle environment, according to one embodiment.

Initially, the vehicle inputs received from the sensors 206 and 208 are mapped 311 to input membership functions. FIGS. 4-6 illustrates an exemplary mapping 311 of position inputs of an example object 120*a* relative to the vehicle 110 to input membership functions from knowledge base 204, for the purpose of determining a risk value posed by the object 120*a*. In the example implementation of FIGS. 4-6, it is assumed that only the X and Y axis position contributes to an object's risk value. In practice, many other inputs will contribute to the risk value, including at least some or all of the inputs described above. Further, in the example of FIGS. 4-6 the risk posed by object 120*a* is only determined with respect to one quadrant, however it is possible for a single object 120*a* to generate a non-zero risk value in more than one quadrant at a time.

FIG. 4 is an exemplary grid illustration 400 of a vehicle environment 100, according to one embodiment. The grid 400 is illustrative of one way in which the vehicle environment 100 can be divided up into a series of membership functions. In the example embodiment of FIG. 4, the grid lines 410 correspond to distances in either the X or Y direction away from the vehicle 110. Note that in FIG. 4, the X and Y axes are not on the same scale. Object 120*a* is located at position Xa, Ya, on the X and Y axes, respectively.

FIG. 5 illustrates example input membership functions for the position input of an object 120 relative to the vehicle 110. In this example, the X and Y position inputs are considered to be separate inputs, although they need not be in different embodiments. Generally, any input can be a member of more than one input membership function. As described herein, membership of an input to a membership function includes partial membership. In the example illustrated in FIG. 4, the example object 120*a* has position inputs of Xa equal to −2.5 and Ya equal to 18. Items (a) through (d) in FIG. 5 illustrate the different possible memberships of the example Xa and Ya position inputs. For example, the Xa position input is a member of two input measurement functions (a) and (b), highlighted in bold.

Particularly, (a) illustrates the membership of the Xa position input in the input membership function between −3 and 3 on the X axis, (b) illustrates the membership of the Xa position input in the membership function between 0 and −6 on the X axis, (c) illustrates the membership of the Ya position input in the membership function covering positions greater than 10 on the Y axis, and (d) illustrates the membership of the Ya position input in the membership function between 0 and 20 on the Y axis.

In the example of FIG. 5, each example input membership function is illustrated as a triangle. In general, any shape of function may be used for a membership function including, for example, a piece-wise linear function, a Gaussian distribution function, a sigmoid function, a quadratic and/or cubic polynomial function, and a bell function.

Although illustrated as mostly identical, the input membership functions do not need to be identical across different values of the input. Using the X position input as an example, the membership functions may be different functions entirely further out along the X axis from the vehicle 110, and/or may be shaped differently further out along the X axis. The outermost position input membership functions in FIG. 5 illustrate this.

The extent to which an input is considered to be a member of an input membership function is referred to as a degree of membership. The ECU 202 processes each input to determine a degree of membership for each input membership function of which it is a partial member. The degree of membership an input has to an input membership function is the point on a curve of an input membership function that matches the input. Often, the degree of membership is a value between a limited range, such as between 0 and 1, inclusive, though this is not necessarily the case. The degree of membership is divorced by at least one step from the numerical value of the input. For example, as above, the Xa position input of object 120*a* is −2.5. However as illustrated in (a) and (b), the degree of membership is 0.25 for input membership function (a) between −3 and 3, and is 0.75 for input membership function (b) between −6 and 0.

To determine the risk value of an object, the various inputs of a single rule are combined 312. To do this, the input membership functions of which the inputs are members are combined 312. These input membership functions are combined based on the degrees of membership of the inputs and the combination is performed using one or more combination logical operators. The logical operation/s chosen for the combination 312 affects how the inputs, input membership functions, and degrees of membership contribute to the risk value for the object.

The logical operators are chosen from a superset of the Boolean logic operators, referred to as the fuzzy logic operators. These include, for example, the AND (the minimum of A and B, or min (A,B), or MIN), OR (the maximum of A and B, or max (A,B), or MAX), and NOT (not A, or 1-A, or NOT) logical operators. Other examples of logical operators include other logical operators that perform intersections (or conjunctions), unions (or disjunctions), and complements. These include triangular norm operators and union operators, each of which may have their own logical requirements regarding boundaries, monotonicity, commutativity, and associativity.

In this example, the Xa and Ya position inputs are combined using the MIN logical operation. The output of the combination logical operation is a discrete value. As illustrated in FIG. 5, (a) has a degree of membership of 0.25, (b) has a degree of membership of 0.75, (c) has a degree of membership of 0.75, and (d) has a degree of membership of 0.25.

As inputs may be members of several different input membership functions, there are a number of different possible permutations for combining 312 the various memberships of the various inputs. For example, FIG. 5 illustrates duplicates of (a) and (b) in order to illustrate the four different ways the position input's memberships can be permuted for combination 312.

Each possible permutation of input membership functions corresponds with a risk membership function. The risk membership functions and their associations with permutations of input membership functions are stored in knowledge base 204. The risk membership functions are associated with possible risk values that are used to determine the risk value of an object 120. To determine the risk value of an object, the permutations of input membership functions of which the inputs are members are mapped to corresponding risk membership functions 313. This mapping 313 can occur in parallel with, or before or after the combination 312, as one does not depend on the other.

FIG. 6 illustrates a set of example risk membership functions, according to one embodiment. The example risk membership functions of FIG. 6 map 313 to the input membership functions illustrated in FIG. 5 of which the position inputs are members. Particularly, risk membership function (e) maps 313 to the combination of input membership functions (a) and (c). That is, risk membership function (e) map 313 to the permutation of the X-axis input membership function between −3 and 3 with the Y-axis input membership function between 10 and above. Risk membership function (e) is a triangle function covering risk values between 2 and 6. Similarly, risk membership function (f) maps 313 to the permutation of input membership functions (b) and (c), and covers risk values between 4 and 8, (g) maps 313 to the permutation of (b) and (d) and covers risk values between 6 and 10, and (h) maps 313 to the permutation of (a) and (d) and covers risk values between 4 and 8. More than one permutation of input membership functions may map to the same risk membership function. For example, risk membership functions (f) and (h) are identical.

An implication logical operation 314 is performed to determine the contribution of each of the risk membership functions from mapping 313 to the risk value for an object 120. The implication logical operation 314 operates on the risk membership function and the output of the combination logical operation 312 corresponding to that risk membership function. In contrast to the combination logical operation 312, the output of the implication logical operation 314 is a modified (or adjusted) risk membership function 313. Examples of implication logical operations 314 include the MIN function described above, as well as a MAX(a,b) function that takes the maximum of a and b, and probabilistic OR function which follows the form of PROBOR(a,b)=a+b−(a)(b). Other functions may be used as well.

In this example, the MIN implication logical operation is used. Thus, the output of the implication logical operation 314 is the MIN of the result of the previously determined combination 312 and the risk membership function 313 corresponding to that permutation. In FIG. 6, the dashed lines represent the combination outcome 312 that is being compared against the corresponding risk membership function 313, and the hashed areas represent the outcome of the implication logical operation 314.

For example, risk membership function (e) corresponds to the combination 312 of input membership functions (a) and (c) where the MIN of the combination was 0.25 (see FIG. 5), thus the dashed line in (e) is drawn at 0.25. Risk membership function (e) is the triangle that covers risks between 2 and 6. The outcome of the implication logical operation 314 is an altered risk membership function delineated by the hashed area bounded by (e). Item (f)-(h) illustrate the outcomes of the implication logical operation on the other possible permutations introduced above.

The adjusted risk membership functions are aggregated 315 using an aggregation logical operation. The aggregation logical operation may be performed using any logical operation described above, or more generally any commutative logical operation, including, for example, a SUM function that sums the adjusted risk membership functions, or a MAX function as described above. This example illustrates aggregation using the MAX function. Item (i) illustrates the aggregated risk membership functions from items (e)-(h) above. The result of the aggregation 315 may either be another function or a single numerical value.

The risk value of an object is determined 316 using an output logical operation and the result of aggregation 315. The output logical operation may be any function including, for example, a centroid function, a bisector function, a middle of maximum function (i.e., the average of the maximum value of the aggregation result), a largest of maximum function, and a smallest of maximum function. In the example of FIG. 6, the centroid function is used to determine a risk value of 6 for object 120*a*.

The determination of a risk value for an object by the driver assistance system described above with respect to FIG. 3B and FIGS. 4-6 may be repeated for other quadrants for the same object, for other objects 120 in any quadrant of the environment 100, and is equally applicable to implementations using many more inputs, including all inputs described above with respect to sensors 206 and 208.

Figure 7:
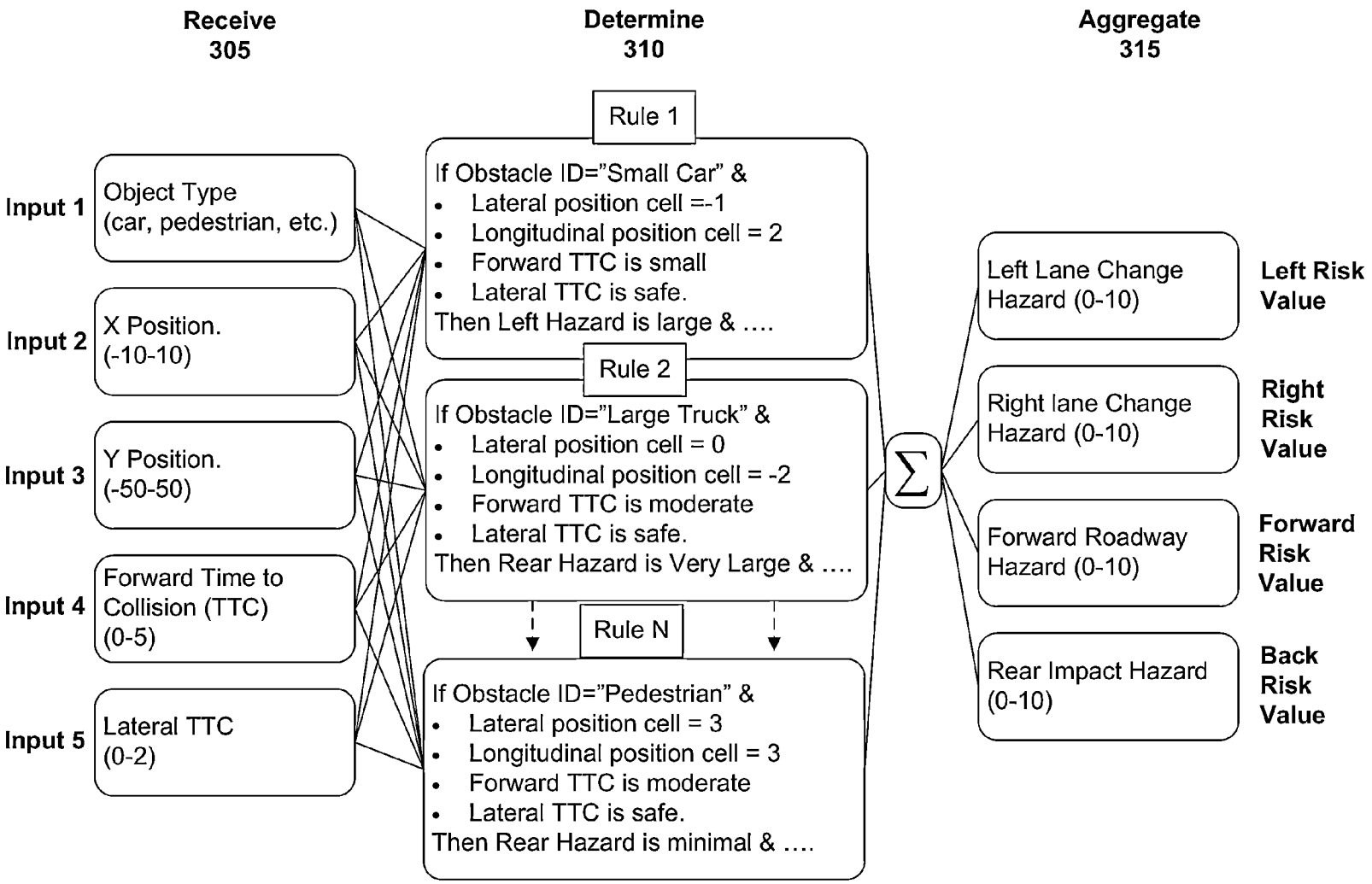
FIG. 7 is a block diagram illustrating an exemplary analysis of the risks posed by objects detected in the vehicle environment, according to one embodiment.

FIG. 7 generalizes the exemplary determination of risk values described in FIGS. 3-6. FIG. 7 is a block diagram illustrating an exemplary analysis of the risks posed by objects 120 detected in the vehicle environment 100, according to one embodiment. FIG. 7 illustrates a larger set of example inputs than the prior example, including a type of object input, an X position input, a Y position input, a forward time to collision (TTC) input, and a lateral TTC input. The time to collision may be computed based on velocity and acceleration inputs for the vehicle 110 and objects 120 from the sensors 206 and 208.

Although processing of inputs using rules is described rigorously above, FIG. 7 illustrates example rules in a more semantic form. Each example rule illustrated in FIG. 7 describes an antecedent (e.g., "if") including a set of matching conditions for the inputs (e.g., permutations of memberships functions the inputs are members of to match that rule). Each rule also includes a consequent (e.g., "then") including a set of risk membership functions matching the permutation specified by the antecedent. The logical operations described above may be specific to particular rules or they may be shared between rules.

Aggregating Object Risk Values by Quadrant

Referring back to FIG. 3A, risk values for individual objects 120 may be determined 310 as described above with respect to the examples of FIGS. 3B-7 above. Once the risks for objects 120 have been determined 310, the risks are aggregated 315 by quadrant to determine the quadrant risks 204. In one embodiment, the rules specify which quadrant each object risk contributes to. In another embodiment, the quadrant an object risk contributes to is determined by its physical position (e.g., X axis and Y axis position) in relation to the vehicle 110.

The aggregate risk value for all objects 120 in a quadrant can be determined using a variety of logical operations. In one embodiment, a quadrant risk value 204 may be determined by summing the risk values of the objects 120 in that quadrant. In another embodiment, the quadrant risk can be obtained by applying the aggregation logical operation 315 (e.g., the MAX function) for the already-implicated (314) risk membership functions for all objects 120 in the quadrant. The quadrant risk value can be computed, for example, by taking the centroid 316 of the resulting aggregated functions for all objects in the environment.

Individual quadrant risk values 204 may be normalized, for example based on the number of objects 120 in that quadrant. Additionally, all four quadrant risk values 204 may be normalized, for example based on the sum of all four quadrant risk values. In this way, object risk values and quadrant risk values are all on the same bounded scale, such that relative differences between risk values indicate different levels of risk to the vehicle 110 and its occupants.

Adjusting Risk Values

Risk values may be adjusted based on inputs received by the vehicle 110 which are not directly tied to individual rules or objects 120, but which nevertheless affect the risks posed to the vehicle 110. Object and quadrant risk values may be adjusted in this manner by local inputs and/or by global inputs.

Local inputs are inputs affect individual object risk values and quadrant risk values differently. For example, a direction of a driver's attention such as a head direction input or an eye gaze direction input may have been received from an internal sensor 208 indicating that the driver's is looking to the left at that instant in time. Consequently, the ECU 202 may alter the right quadrant risk value and/or object risk values for objects on the right to be higher than they would be otherwise, due to the driver's lack of attention on that region. Similarly, the ECU 202 may alter the left quadrant risk value and/or object risk values for objects on the left to be lower than they would be otherwise, in this case due to the driver's known attention to that region.

In another embodiment, local inputs are incorporated into the object risk value determination process described above with respect to FIGS. 3B-7 above.

Alternatively, rather than adjusting object risk values individually, local inputs may be used to adjust the quadrant risk values instead. Using the example above of eye gaze input indicating that the driver's eyes are looking to the left, the ECU may adjust the left quadrant risk value downward versus what it would be otherwise, and may adjust the right quadrant risk upward versus what it would be otherwise.

Object and quadrant risks may also be adjusted based on global inputs that are applied to all objects and/or quadrants equally. Global inputs affect all risk values equally on the basis that they are expected to either negatively affect a driver's ability to react to risks in the vehicle environment 110, and/or negatively affect a driver's ability to mitigate the harm caused by those risks. Examples of global inputs include, for example, weather, road conditions, time of day, driver drowsiness, seat belt warnings, and the weight on each passenger seat. More specifically, poor weather conditions (e.g., rain, fog, snow), hazardous road condition (e.g., wet roads, snow covered roads, debris on the roadway, curvy roadway), nighttime or dusk, indications that the driver is drowsy, and indications that one or more seatbelts are unbuckled while the weight on those seats indicates a person is seated are all examples of global inputs that increase risk values. Conversely, favorable weather conditions (e.g., dry roads), favorable road conditions (e.g., straight roadway, no known hazards), daytime, indications that the driver is not drowsy, and indications that all needed seatbelts are strapped in are all examples of global inputs that reduce risk values.

Driver cognitive load is another example of a global input. Due to multi-tasking, such as cell phone use, entering information in a car's onboard navigation system, adjusting thermostat, changing radio stations, etc., the driver may be paying attention to things other than the road. The ECU 202 may receive inputs regarding the driver's cognitive load. For example, eye gaze input and inputs from vehicle electronics may indicate the total time or frequency with which the driver's attention is diverted from the road. The ECU 202 may be configured to convert this into a driver cognitive load input, which may in turn be used as a global input for determining risk values.

As another example, in addition to using gaze direction (or driver head pose) as a local input, gaze direction may also be used to determine the relative attentiveness of the driver to the forward roadway. Driver attentiveness to the forward roadway is a global input. With respect to driver gaze direction, merely glancing away from the road does not necessarily imply a higher risk of accident. In contrast, brief glances by the driver away from the forward roadway for the purpose of scanning the driving environment are safe and actually decrease near-crash/crash risk. However, long glances (e.g., two 2 seconds) increase near-crash/crash risk. In one embodiment, gaze direction is combined with duration of gaze direction to determine the driver attentiveness input. The driver attentiveness input may be described by a modulation factor that is a function of the time duration that the driver is not attentive to the forward roadway based on the gaze direction (or, alternatively, the head-pose direction).

Vehicle State Prediction

Overview

In addition to determining the risks posed by objects in the vehicle's environment based on current information about those objects as described above, the driver assistance system is also capable of determining the risks posed by those objects based on predictions of where those objects are expected to be located in the near future. As the vehicle's environment can change rapidly, the driver may not have the capacity to respond to other driver's actions quickly enough to prevent an accident. By incorporating predicted object positions into its risk assessments, the driver assistance system is able to further mitigate the risks posed by objects in the vehicle's environment. This function of the driver assistance system is also referred to as vehicle state prediction, however the driver assistance system is capable of predicting the state of any kind of object, examples of which are provided above.

Figure 10:
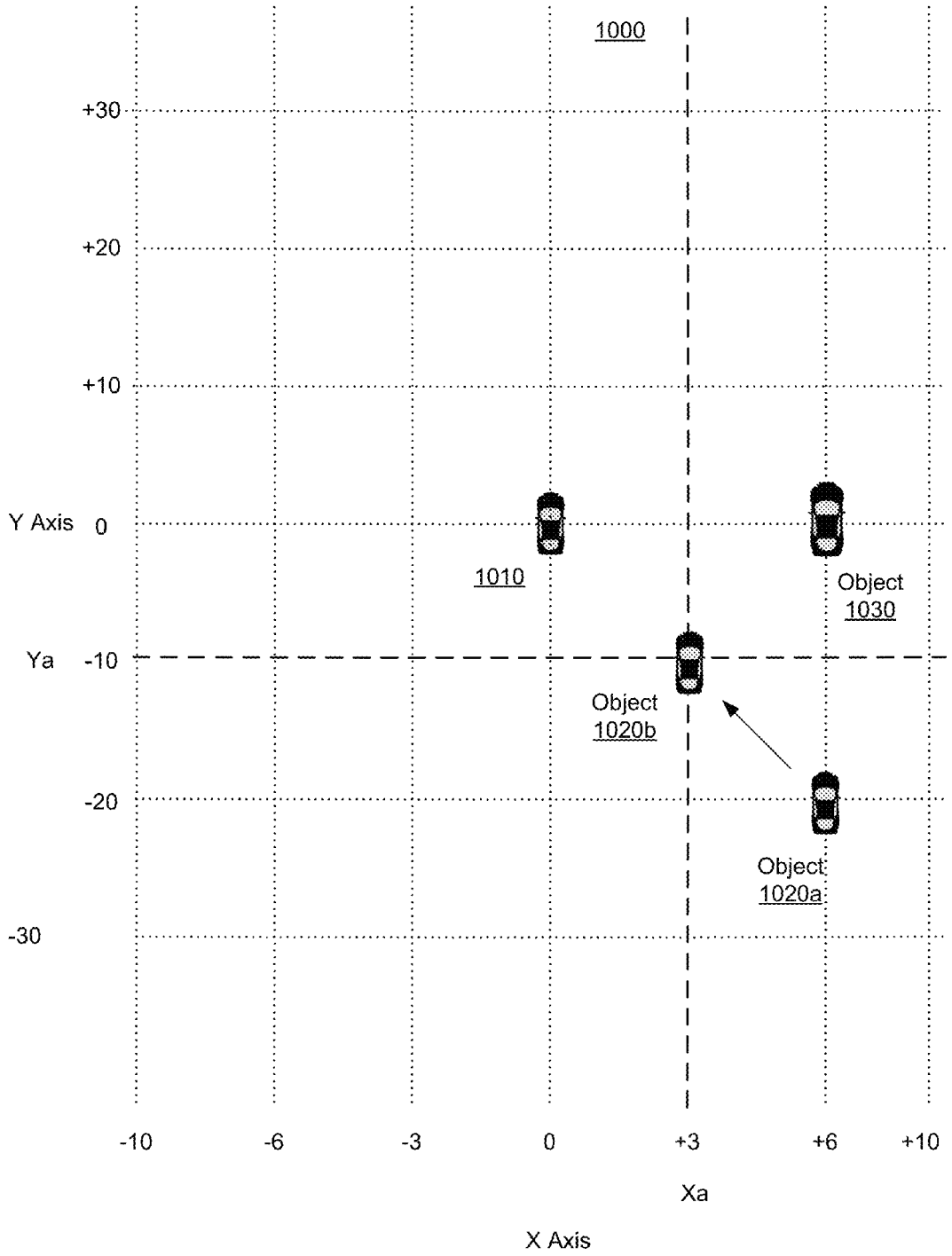
FIG. 10 is a grid illustration of an exemplary vehicle environment, according to one embodiment.

FIG. 10 is a grid illustration of an exemplary vehicle environment, according to one embodiment. FIG. 10 illustrates an example situation where vehicle state prediction allows the driver assistance system to provide additional actionable information in its risk determination. In the example of FIG. 10, inputs indicate one object 1020*a* (e.g., a car) is determined to be accelerating towards another object 1030 (e.g., another car). In this example, inputs received by the sensors of the vehicle can provide a current time to collision (TTC) based on the relative distance between object 1030 and object 1020*a*, and based on the velocities of the two objects. Further, a change in time to collision (ΔTTC) can be determined based on the acceleration of object 1020*a* relative to a change in acceleration of object 1030.

If object 1020*a* is accelerating faster than object 1030, at some point object 1020*a* will overtake object 1030, assuming all factors remain constant. The TTC and the ΔTTC provide a numerical measure of how soon this will occur. As a consequence, it is most likely that one of a finite number of outcomes will occur. Either object 1030 will accelerate, object 1020*a* will slow down, object 1030 will change lanes, object 1020*a* will change lanes, or a collision will occur. Although it is possible that other outcomes may also occur, generally the likelihood of these outcomes is considered sufficiently low so as to not merit the additional processing power to compute the risk involved.

Figure 9A:
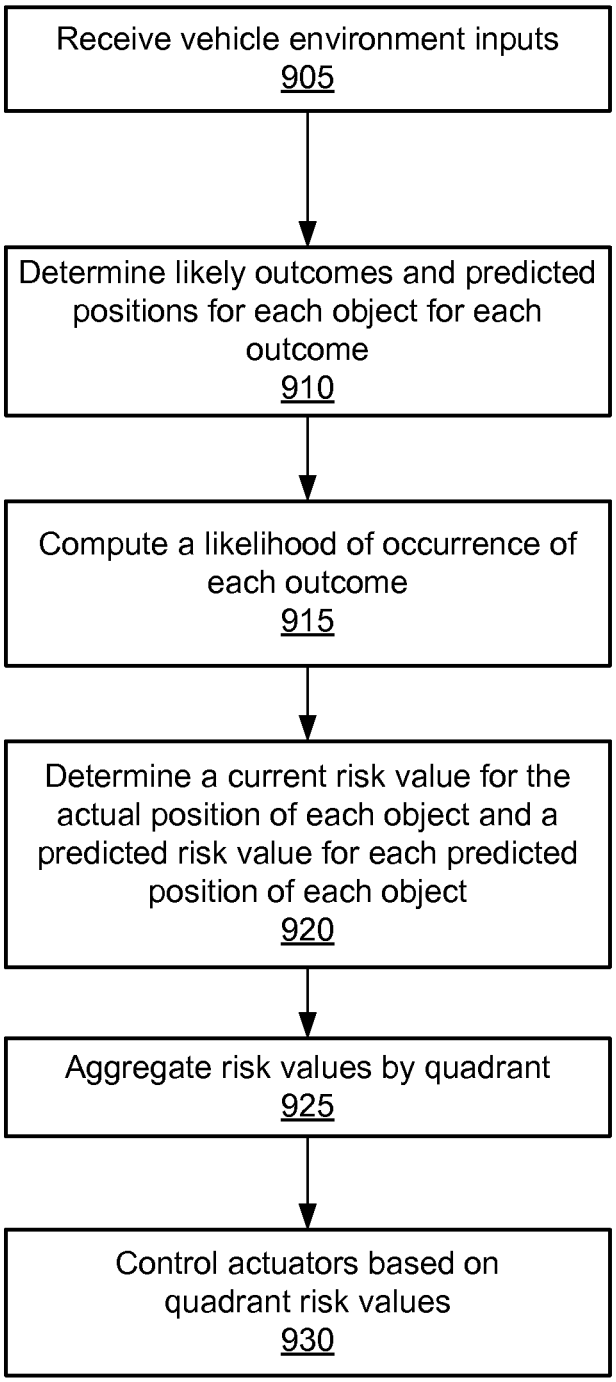
FIG. 9A is a block diagram illustrating an exemplary process for assisting a driver using vehicle state prediction, according to one embodiment.

FIG. 9A is a block diagram illustrating an exemplary process for assisting a driver using vehicle state prediction, according to one embodiment. The driver assistance system receives 905, in real time, a plurality of vehicle environment inputs through sensors 206 and 208. These inputs provide information about the current position of each object in the vehicle's environment, along with other information as described above.

The driver assistance system processes the inputs to determine 910 or access a number of predicted outcomes that could occur based on the objects in the vehicle environment. For example, the possible outcomes may be stored in the knowledge base 204, such that each possible outcome is associated with a set of predetermined criteria. By providing matching the inputs to the criteria, the driver assistance system can match which possible outcomes match the inputs. Alternatively, the possible outcomes may be determined in real time.

The driver assistance system also determines 910, for each possible outcome, a predicted position for each object involved in the situation should that outcome occur. For example, for the outcome where object 1020*a* changes lane to the left 1020*b*, the driver assistance system may predict that after changing lanes, object 1020*b* will be located at position 3, −10 in the blind spot of the driver. The prediction position for each object may be based on information stored in knowledge base 204. The predicted position may be a static numerical X/Y position, or it may be dynamic based on the inputs. For example, for object 1020*b*, the predicted position may be based on object 1020*a*'s current position, velocity, acceleration, and lane size information.

For each outcome, the driver assistance system computes 915 a likelihood of that outcome occurring. The computation is based on a set of rules from knowledge base 204. Computation of the likelihood of an outcome is described below. Using the example above from FIG. 10, it may be determined that there is a 35% likelihood that object 1020*a* will change lanes to the left (object 1020*b*), a 25% likelihood that object 1020*a* will change lanes to the right (not shown), a 10% likelihood that object 1030 will accelerate, a 20% chance that object 1020*a* will decelerate, a 9% chance that object 1030 will change lanes to the right (not shown), and a 1% chance of collision.

The driver assistance system determines 920, for each predicted position of each object and outcome, a predicted risk value. For example, object 1020*b* poses a certain amount risk to the driver 1010 based on its predicted position at position −3, −10. Predicted risk values are calculated similarly to the risk values determined for the current positions of objects described above with respect to FIGS. 3-7 (referred to as current risk values, for clarity). However, in calculating a predicted risk value the predicted position is used in place of the object's current position. In other embodiments, inputs other than position inputs may also be altered other than position used in the predicted risk determination. Examples include predicted velocities and accelerations of objects.

Generally, because there may be more than one possible outcome to a situation, any given object may have several different predicted risk values based on the number of possible outcomes of a situation it is involved in. For example, the predicted risk for objects 1020*a* if it makes a lane change (e.g., 1020*b*) is expected to be different than the predicted risk if object 1020 slows down instead.

The driver assistance system determines total risk posed by an object in a vehicle's environment as a weighted sum of the object's current risk value, and the object's predicted risk value for each outcome weighted by the computed likelihood of that outcome. The driver assistance system may also adjust risk values as described above, and aggregate 925 quadrant risks above for use in controlling 930 vehicle actuators.

Likelihood of Outcome Occurrence

Figure 9B:
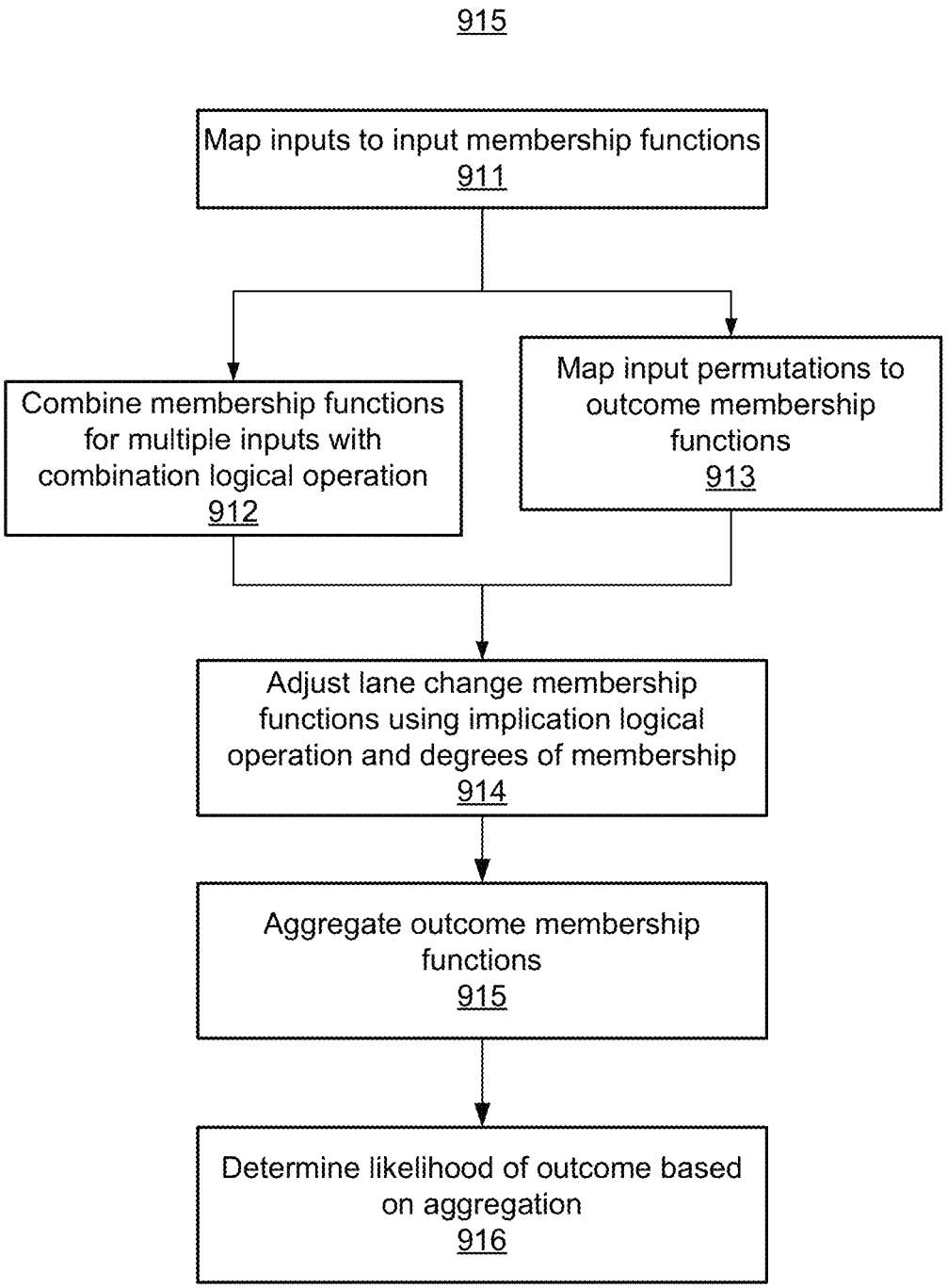
FIG. 9B is a block diagram illustrating an exemplary process for computing the likelihood of outcome occurring, according to one embodiment.

FIG. 9B is a block diagram illustrating an exemplary process for computing the likelihood of outcome occurring, according to one embodiment. FIG. 9B describes a process for determining 915 the likelihood of an outcome using the set of rules from the knowledge base 204, according to one embodiment. Each rule includes a set of inputs, a set of input membership functions, a set of outcome membership functions, and mappings between permutations of input membership functions and outcome membership functions. These concepts will be described further below.

Figure 11:
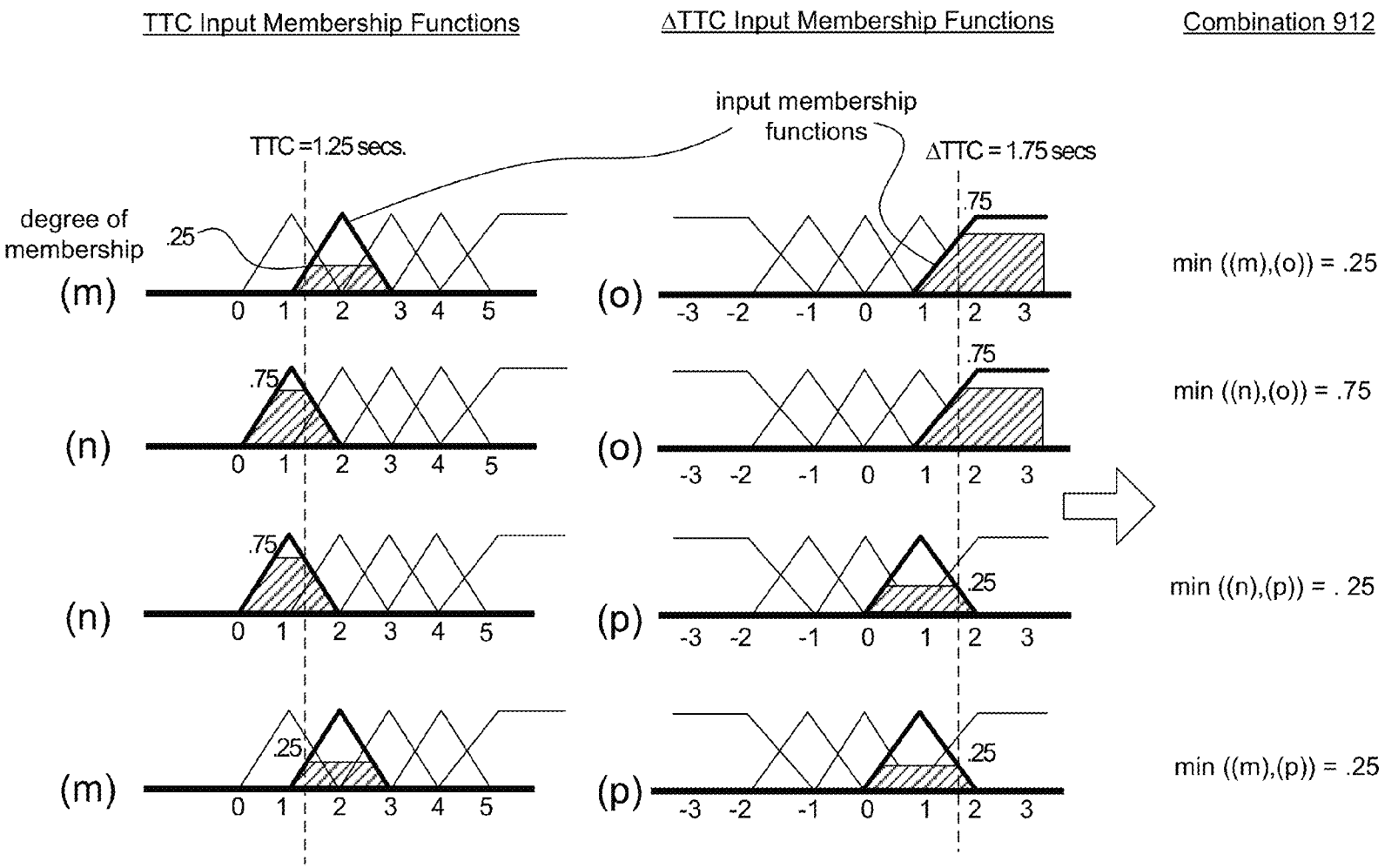
FIG. 11 illustrates exemplary input membership functions for evaluating the risk of an object in the vehicle environment, according to one embodiment.
Figure 12:
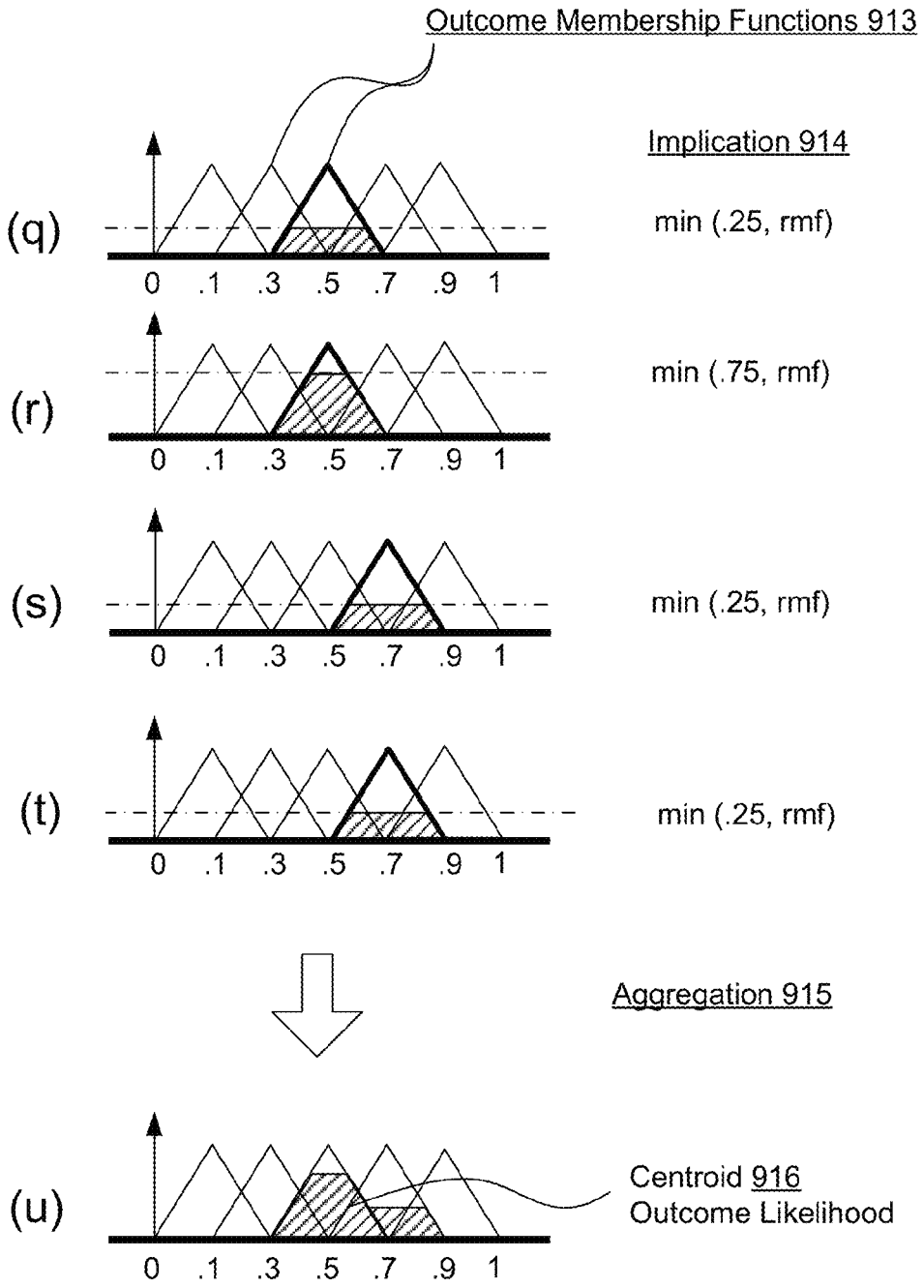
FIG. 12 illustrates exemplary risk membership functions for evaluating the risk of an object in the vehicle environment, according to one embodiment.

Initially, the vehicle inputs received from the sensors 206 and 208 are mapped 911 to input membership functions. FIGS. 11-12 illustrates an example mapping 911 of inputs of an example object 1020*b* relative to the vehicle 1010 to input membership functions from knowledge base 204, for the purpose of determining the likelihood of an outcome. In the example situation of FIGS. 11-12, it is assumed that only the TTC and ΔTTC inputs contributes to an outcome's likelihood. In practice, many other inputs will contribute to an outcome's likelihood, including at least some or all of the inputs described above. Further, in the example of FIGS.

11-12 the likelihood of only a single outcome is determined, whereas in practice there are multiple possible outcomes for each situation. Generally, each outcome's likelihood is determined separately.

FIG. 11 illustrates exemplary input membership functions for evaluating the likelihood of an outcome, according to one embodiment. In the example of FIG. 11, the input membership functions for TTC each cover a different range of seconds, for example one from 0-2 seconds, another from 1-3 seconds, etc. The input membership functions for ΔTTC also cover ranges of seconds, for example one from −2 to 0, another from −1 to 1, etc. Here, negative ΔTTCs indicate that the collision is becoming less likely, for example because object 1020*a* is decelerating and/or object 1030 is accelerating. Positive ΔTTCs indicate that the collision is becoming more likely, for example object 1020*a* is accelerating and/or object 1030 is decelerating. In other embodiments, TTC and ΔTTCs may be combined to contribute to a same input membership function.

In the example illustrated in FIG. 11, objects 1020*a* and 1030 have a TTC of 1.25 seconds and a ΔTTC of 1.75 seconds. Items (m) through (p) in illustrate the different possible memberships of the example TTC and ΔTTC inputs. For example, the TTC position input is a member of two input measurement functions, illustrated in items (m) and (n) and highlighted in bold.

Particularly, item (m) illustrates the membership of the TTC input in the input membership function between 1 and 3 seconds. Item (n) illustrates the membership of the TTC input in the input membership function between 0 and 2 seconds. Item (o) illustrates the membership of the ΔTTC input in the input membership function greater than 1 second. Item (p) illustrates the membership of the ΔTTC input in the input membership function between 0 and 2 seconds. For degrees of membership, for (m) the TTC input has a degree of membership of 0.25, for (n) the TTC input has a degree of membership of 0.75, for (o) the ΔTTC input has a degree of membership of 0.75, and for (p) the ΔTTC input has a degree of membership of 0.25. Degrees of membership are as further described above for risk value determination To determine the likelihood of an outcome, the various inputs of a single rule are combined 912 based on their respective degrees of membership in input membership functions using one or more combination logical operators. The logical operation/s chosen for the combination 912 affects how the inputs, input membership functions, and degrees of membership contribute to the likelihood of an outcome. The logical operators are chosen as described above for risk value determination.

The various permutations of the degrees of membership of the TTC and ΔTTC inputs in input membership functions are combined 912 using the MIN logical operation. The output of the combination 912 logical operation of each permutation is a discrete value. In this example, the combination 912 of (m) and (o)) is 0.25, of (n) and (o) is 0.75, of (n) and (p) is 0.25, and of (m) and (p) is 0.25.

Each possible permutation of input membership functions corresponds with a outcome membership function. The outcome membership functions and their associations with permutations of input membership functions are stored in knowledge base 204. The outcome membership functions are associated with possible outcome likelihoods that are used to determine the likelihood of a particular outcome. To determine the likelihood of an outcome, the permutations of input membership functions of which the inputs are members are mapped to corresponding outcome membership functions 913. This mapping 913 can occur in parallel with, or before or after the combination 912, as one does not depend on the other.

FIG. 12 illustrates a set of example outcome membership functions, according to one embodiment. The example outcome membership functions of FIG. 12 map 913 to the input membership functions illustrated in FIG. 11 of which the TTC and ΔTTC inputs are members. Particularly, item (q) illustrates the outcome membership function mapping 913 to the combination 912 of items (m) and (o). The outcome membership function in item (q) is a triangle function covering outcome likelihoods expressed as numerical values between 0.3 and 0.7 (e.g., between 30% and 70%). Similarly, item (r) maps 913 to the permutation of items (n) and (o) and covers outcome likelihoods between 0.3 and 0.7, item (s) maps 913 to the permutation of items (n) and (p) and covers likelihoods between 0.5 and 0.9, and item (t) maps 913 to the permutation of items (m) and (p) and covers likelihoods between 0.5 and 0.9. More than one permutation of input membership functions may map to the same outcome membership function. For example, items (q) and (r) both map to the same outcome membership functions.

To determine the contribution of each of the outcome membership functions from the mapping 913 to an outcome's likelihood, an implication logical operation 914 is performed. The implication logical operation 914 operates on each combination logical operation 912 and the outcome membership function corresponding to that combination logical operation 912. In contrast to the combination logical operation 912, the output of the implication logical operation 914 is a modified (or adjusted) outcome membership function 913. Examples of implication logical operations 914 include the MIN function described above, as well as a MAX(a,b) function that takes the maximum of a and b, and probabilistic OR function which follows the form of PROBOR(a,b)=a+b−(a)(b). Other functions may be used as well.

In the example of FIGS. 11 and 12, the MIN implication logical operation is used. Thus, the output of the implication logical operation 914 is the MIN of the result of the previously determined combination 912 and the output membership function 913 corresponding to that permutation. In FIG. 12, the dashed lines represent the combination outcome 912 that is being compared against the corresponding outcome membership function 913, and the hashed areas represent the outcome of the implication logical operation 914.

For example, permutation (q) is based on a combination 912 where the MIN of the combination was 0.25 (see FIG. 11), thus the dashed line in (q) is drawn at 0.25. The relevant outcome membership function in this example is the triangle that covers outcome likelihoods between 0.3 and 0.7. The result of the implication logical operation 914 is an altered outcome membership function delineated by the hashed area of permutation (q). Item (r)-(t) illustrate the outcomes of the implication logical operation on the other possible permutations introduced above.

The adjusted outcome membership functions are aggregated 915 using an aggregation logical operation. The aggregation logical operation may be performed using any logical operation described above, or more generally any commutative logical operation, including, for example, a SUM function that sums the adjusted outcome membership functions, or a MAX function as described above. The example of FIG. 12 illustrates aggregation using the MAX function. Item (u) illustrates the aggregated outcome membership functions from items (q)-(t) above. The result of the aggregation 915 may either be another function or a single numerical value.

The outcome's likelihood is determined 916 using an output logical operation and the result of aggregation 915. The output logical operation may be any function including, for example, a centroid function, a bisector function, a middle of maximum function (i.e., the average of the maximum value of the aggregation result), a largest of maximum function, and a smallest of maximum function. In the example of FIG. 12, the centroid function is used to determine an outcome likelihood of 0.6.

In one embodiment, the knowledge base 204 stores the input membership functions, outcome membership functions, and the mappings 913 between them in a table. This speeds processing of the outcome likelihood, as the mapping 913 is already stored in advance and does not need to be separately determined each time. It also more conveniently illustrates how various inputs lead to various outcome likelihoods. Table 1 is an example rule table for the TTC and ΔTTC inputs. In practice, a rule table may include many more possible inputs, consequently many more possible cells. The row and column headers represent descriptions of the input membership functions, which may be stored in separate positions in the database 204, and the cells store the outcome membership functions, described below in descriptive rather than mathematical terms.

TABLE 1

TTC and ΔTTC Rule Table

| | | TTC | | | | |
|---|---|---|---|---|---|---|
| | | Imminent 0-2 sec. | Small 1-3 sec. | Medium 2-4 sec. | Large 3-5 sec | Very Large 4+ sec. |
| ΔTTC | Neg. Large −3 to −1 sec. | Very Likely (90%) | Very Likely (90%)) | Likely (70%) | Equally Likely (50%) | Equally Likely (50%) |
| | Neg. Small −2 to 0 sec. | Likely (70%) | Likely (70%) | Equally Likely (50%) | Unlikely (30%) | Unlikely (30%) |
| | Near Zero −1 to 1 sec. | Likely (70%) | Likely (70%) | Equally Likely (50%) | Unlikely (30%) | Unlikely (30%) |
| | Pos. Small 0 to 2 sec. | Likely (70%) | Likely (70%) | Equally Likely (50%) | Unlikely (30%) | Unlikely (30%) |
| | Pos. Large 1 to 3 sec. | Equally Likely (50%) | Equally Likely (50%)) | Unlikely (30%) | Very Unlikely (10%) | Very Unlikely (10%) |

Additional Considerations

Vehicles implementing embodiments of the present description include at least one computational unit, e.g., a processor having storage and/or memory capable of storing computer program instructions that when executed by a processor perform various functions described herein, the processor can be part of an electronic control unit (ECU).

Reference in the specification to "one embodiment" or to "an embodiment" means that a particular feature, structure, or characteristic described in connection with the embodiments is included in at least one embodiment. The appearances of the phrase "in one embodiment" or "an embodiment" in various places in the specification are not necessarily all referring to the same embodiment.

Some portions of the detailed description that follows are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic or optical signals capable of being stored, transferred, combined, compared and otherwise manipulated. It is convenient at times, principally for reasons of common usage, to refer to these signals as bits, values, elements, symbols, characters, terms, numbers, or the like. Furthermore, it is also convenient at times, to refer to certain arrangements of steps requiring physical manipulations or transformation of physical quantities or representations of physical quantities as modules or code devices, without loss of generality.

However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or the like, refer to the action and processes of a computer system, or similar electronic computing device (such as a specific computing machine), that manipulates and transforms data represented as physical (electronic) quantities within the computer system memories or registers or other such information storage, transmission or display devices.

Certain aspects include process steps and instructions described herein in the form of an algorithm. It should be noted that the process steps and instructions could be embodied in software, firmware or hardware, and when embodied in software, could be downloaded to reside on and be operated from different platforms used by a variety of operating systems. An embodiment can also be in a computer program product which can be executed on a computing system.

An embodiment also relates to an apparatus for performing the operations herein. This apparatus may be specially constructed for the purposes, e.g., a specific computer in a vehicle, or it may comprise a general-purpose computer selectively activated or reconfigured by a computer program stored in the computer, which can also be positioned in a vehicle. Such a computer program may be stored in a computer readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), field programmable gate arrays (FPGAs) or any type of media suitable for storing electronic instructions, and each coupled to a computer system bus. Memory can include any of the above and/or other devices that can store information/data/programs. Furthermore, the computers referred to in the specification may include a single processor or may be architectures employing multiple processor designs for increased computing capability.

The algorithms and displays presented herein are not inherently related to any particular computer or other apparatus. Various general-purpose systems may also be used with programs in accordance with the teachings herein, or it may prove convenient to construct more specialized apparatus to perform the method steps. The structure for a variety of these systems will appear from the description above. In addition, an embodiment is not described with reference to any particular programming language. It will be appreciated that a variety of programming languages may be used to implement the teachings as described herein, and any references below to specific languages are provided for disclosure of enablement and best mode.

In addition, the language used in the specification has been principally selected for readability and instructional purposes, and may not have been selected to delineate or circumscribe the inventive subject matter. Accordingly, the disclosure is intended to be illustrative, but not limiting, of the scope of the embodiments.

While particular embodiments and applications have been illustrated and described herein, it is to be understood that the embodiments are not limited to the precise construction and components disclosed herein and that various modifications, changes, and variations may be made in the arrangement, operation, and details of the methods and apparatuses without departing from the spirit and scope of the embodiments.

What is claimed is:

1. A computer based method comprising:

receiving a plurality of vehicle environment inputs, the inputs comprising a current position for each of a plurality of objects located around a vehicle;

determining, based on the inputs, a possible outcome involving the plurality of objects, the possible outcome comprising a predicted position for each of the involved objects;

determining a numerical likelihood of occurrence of the possible outcome based on the inputs;

determining, for each of the involved objects, a current risk value for the object based on the current position of the object, and a predicted risk value for the object based on the predicted position of the object;

determining, for each of the involved objects, a total risk value based on the current risk value and based on the predicted risk value weighted by the numerical likelihood of occurrence; and controlling a driver assistance system of the vehicle based on the total risk values of the involved objects;

wherein determining the numerical likelihood of occurrence of the possible outcome comprises:

determining a plurality of memberships by the inputs in a plurality of input membership functions;

combining the memberships into a plurality of permutations of the input membership functions;

mapping the permutations to a plurality of outcome membership functions;

aggregating the outcome membership functions;

determining the numerical likelihood of occurrence based on the aggregation.

2. The computer based method of claim 1 wherein the inputs comprise a time to collision between two of the plurality of objects, and wherein the numerical likelihood of occurrence is based on the time to collision.

3. The computer based method of claim 2 wherein the inputs comprise a change in the time to collision between the two objects, and wherein the numerical likelihood of occurrence is based on the change in the time to collision.

4. The computer based method of claim 1 wherein the possible outcome is stored in a database, and determining the possible outcome comprises matching a set of criteria to the inputs.

5. The computer based method of claim 4 comprising determining the predicted positions wherein the possible outcome is stored in a database, and is accessed based on the inputs matching a set of criteria for the possible outcome.

6. The computer based method of claim 1 comprising:

determining, based on the inputs, a plurality of possible outcomes involving the plurality of objects, the possible outcomes each comprising a predicted position for each of the involved objects;

determining a numerical likelihood of occurrence for each of the possible outcomes based on the inputs.

7. The computer based method of claim 6 comprising:

determining, for each of the involved objects of each of the possible outcomes, a current risk value for the object based on the current position of the object, and a predicted risk value for the object based on the predicted position of the object for the corresponding possible outcome; and determining, for each of the involved objects, a total risk value based on the current risk value and based on the predicted risk value for each possible outcome weighted by the numerical likelihood of occurrence of that possible outcome.

8. A non-transitory computer readable storage medium including instructions that, when executed by a processor, cause the processor to:

receive a plurality of vehicle environment inputs, the inputs comprising a current position for each of a plurality of objects located around a vehicle;

determine, based on the inputs, a possible outcome involving the plurality of objects, the possible outcome comprising a predicted position for each of the involved objects;

determine a numerical likelihood of occurrence of the possible outcome based on the inputs;

determine, for each of the involved objects, a current risk value for the object based on the current position of the object, and a predicted risk value for the object based on the predicted position of the object;

determine, for each of the involved objects, a total risk value based on the current risk value and based on the predicted risk value weighted by the numerical likelihood of occurrence; and control a driver assistance system of the vehicle based on the total risk values of the objects involved in the possible outcome;

wherein determining the numerical likelihood of occurrence of the possible outcome comprises:

determine a plurality of memberships by the inputs in a plurality of input membership functions;

combine the memberships into a plurality of permutations of the input membership functions;

map the permutations to a plurality of outcome membership functions;

aggregate the outcome membership functions;

determine the numerical likelihood of occurrence based on the aggregation.

9. The non-transitory computer readable storage medium of claim 8 wherein the inputs comprise a time to collision between two of the plurality of objects, and wherein the numerical likelihood of occurrence is based on the time to collision.

10. The non-transitory computer readable storage medium of claim 9 wherein the inputs comprise a change in the time to collision between the two objects, and wherein the numerical likelihood of occurrence is based on the change in the time to collision.

11. The non-transitory computer readable storage medium of claim 8 wherein the possible outcome is stored in a database, and determining the possible outcome comprises matching a set of criteria to the inputs.

12. The non-transitory computer readable storage medium of claim 11 further comprising determining the predicted positions wherein the possible outcome is stored in a database, and is accessed based on the inputs matching a set of criteria for the possible outcome.

13. The non-transitory computer readable storage medium of claim 8 further comprising instructions, that when executed by the processor cause the processor to:

determine, based on the inputs, a plurality of possible outcomes involving the plurality of objects, the possible outcomes each comprising a predicted position for each of the involved objects;

determine a numerical likelihood of occurrence for each of the possible outcomes based on the inputs.

14. The non-transitory computer readable storage medium of claim 13 further comprising instructions, that when executed by the processor cause the processor to:

determine, for each of the involved objects of each of the possible outcomes, a current risk value for the object based on the current position of the object, and a predicted risk value for the object based on the predicted position of the object for the corresponding possible outcome; and determine, for each of the involved objects, a total risk value based on the current risk value and based on the predicted risk value for each possible outcome weighted by the numerical likelihood of occurrence of that possible outcome.

* * * * *